US008879767B2

(12) United States Patent
Wickstrom

(10) Patent No.: US 8,879,767 B2
(45) Date of Patent: Nov. 4, 2014

(54) ACOUSTIC APPARATUS AND METHOD OF MANUFACTURING

(75) Inventor: Timothy K. Wickstrom, Elk Grove Village, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 13/571,566

(22) Filed: Aug. 10, 2012

(65) Prior Publication Data

US 2013/0156235 A1 Jun. 20, 2013

Related U.S. Application Data

(60) Provisional application No. 61/525,395, filed on Aug. 19, 2011.

(51) Int. Cl.
*H04R 9/08* (2006.01)
*H04R 31/00* (2006.01)
*H04R 19/04* (2006.01)

(52) U.S. Cl.
CPC ..... *H04R 19/04* (2013.01); *H04R 31/00* (2013.01)
USPC ..... 381/361; 381/174; 381/355; 381/369; 381/357

(58) Field of Classification Search
USPC ..... 381/174, 175, 360, 361, 355, 369, 357
See application file for complete search history.

(56) References Cited

U.S. PATENT DOCUMENTS 7,933,428 B2 * 4/2011 Sawada ..... 381/357
8,290,184 B2 * 10/2012 Yueh ..... 381/174
8,351,634 B2 * 1/2013 Khenkin ..... 381/361
2009/0180655 A1 * 7/2009 Tien et al. ..... 381/361
2010/0195864 A1 8/2010 Lutz et al.
2010/0202649 A1 8/2010 Inoda et al.

FOREIGN PATENT DOCUMENTS

EP 2051539 4/2009
JP 2007124449 5/2007

OTHER PUBLICATIONS

International Search Report and Written Opinion for related PCT Application No. PCT/US2012/050721, Feb. 27, 2013, 9 pages.
International Preliminary Report on Patentability for PCT/US2012/050721, Mar. 6, 2014, 7 pages.

* cited by examiner

*Primary Examiner* — Davetta W Goins
*Assistant Examiner* — Amir Etesam
(74) *Attorney, Agent, or Firm* — Fitch, Even, Tabin & Flannery LLP

(57) ABSTRACT

A microphone assembly comprising includes a base, at least one side wall, and a cover. The side wall is disposed on the base. The cover is coupled to the at least one side wall. The base, the side wall, and the cover form a cavity and the cavity has a MEMS device disposed therein. A top port extends through the cover and a first channel extends through the side wall. The first channel is arranged so as to communicate with the top port. A bottom port extends through the base. The MEMS device is disposed over the bottom port. A second channel is formed and extends along a bottom surface of the base. The second channel extends between and communicates with the first channel and the bottom port. Sound received by the top port is received at the MEMS device.

12 Claims, 7 Drawing Sheets

ACOUSTIC APPARATUS AND METHOD OF MANUFACTURING

CROSS REFERENCE TO RELATED APPLICATION

This patent claims benefit under 35 U.S.C. §119 (e) to U.S. Provisional Application No. 61/525,395 entitled "Acoustic Apparatus And Method Of Manufacturing" filed Aug. 19, 2011, the content of which is incorporated herein by reference in its entirety.

TECHNICAL FIELD

This application relates to acoustic devices and, more specifically, to their construction and input configuration.

BACKGROUND OF THE INVENTION

Various types of microphones and receivers have been used through the years. In these devices, different electrical components are housed together within a housing or assembly. For example, a microphone typically includes micro-electro-mechanical system (MEMS) device, a diaphragm, and integrated circuits, among other components and these components are housed within the housing. Other types of acoustic devices may include other types of components.

Microphones can be configured and assembled in a variety of different ways. For instance, the microphone can be configured so that sound energy enters through a "top" port in the microphone (i.e., a port located on a top surface of the microphone assembly). In another example, the microphone can be configured so that sound energy enters through a "bottom" port in the microphone (i.e., a port located on a bottom surface of the microphone assembly).

The choice of whether to use a microphone that is configured with a top port or a bottom port may be dictated by the geometry of space where the microphone is deployed (e.g., in a cell phone, personal computer, hearing aid, or some other electronic device to mention a few examples). For example, in some instances this geometry may dictate that a top port must be used while in other circumstances a bottom port may be required.

The bottom port configuration offer some advantages over top port configured devices. For example, the back volume of microphones with bottom ports is generally larger than the back volumes of devices that utilize top ports. Since, generally speaking, the larger the back volume, the better the performance of the microphone, it is often desired to use bottom port microphones. Unfortunately, top port devices are often required and, therefore, users cannot take advantage of the increased back volume typically found in bottom port devices.

BRIEF DESCRIPTION OF THE DRAWINGS

For a more complete understanding of the disclosure, reference should be made to the following detailed description and accompanying drawings wherein.

Figure 1A:
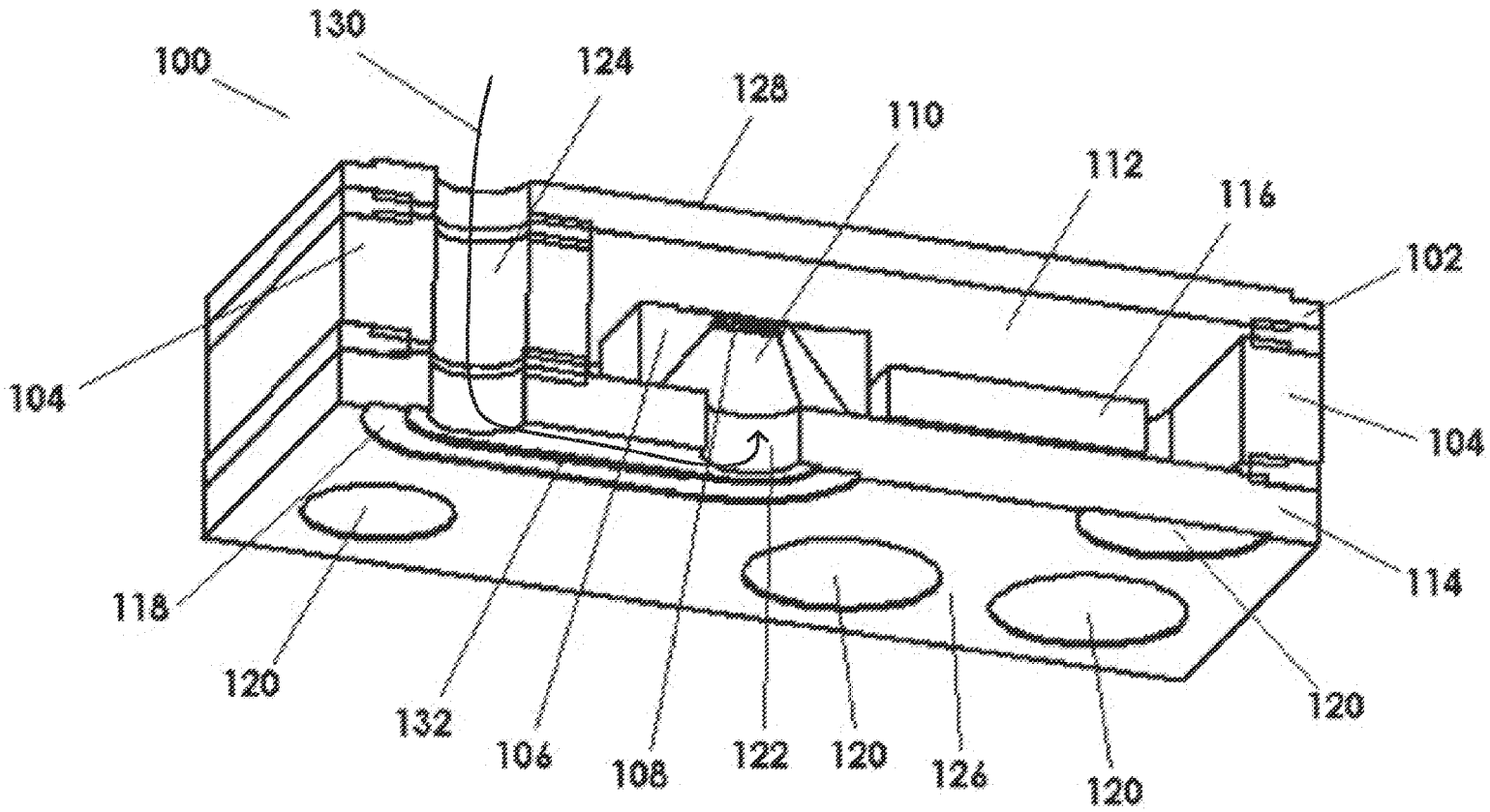
FIG. 1A is a bottom cutaway perspective view of one example of a microphone apparatus according to various embodiments of the present invention.
Figure 1B:
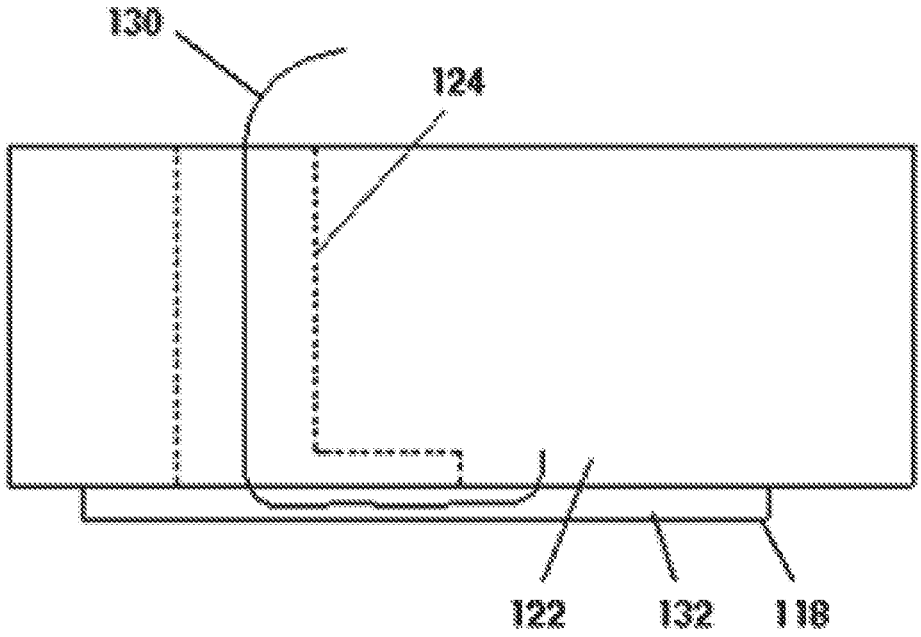
FIG. 1B is a side cutaway view of a portion of the microphone apparatus of FIG. 1A according to various embodiments of the present invention.
Figure 1C:
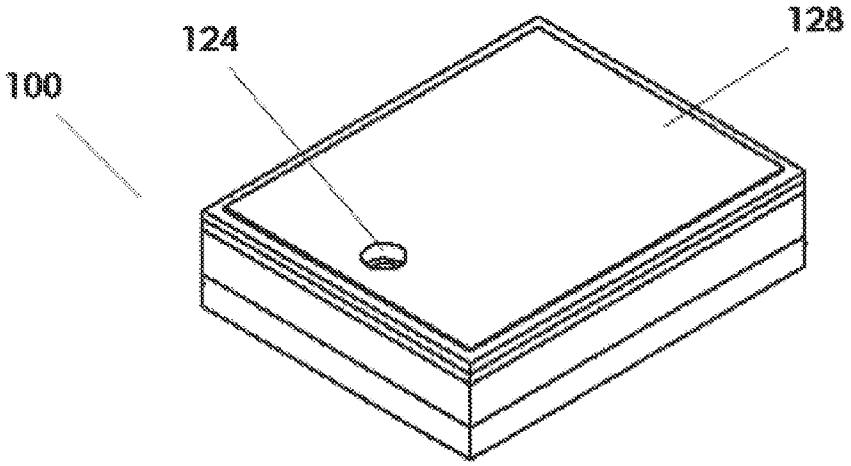
FIG. 1C is a top perspective view of the microphone apparatus of FIG. 1A according to various embodiments of the present invention.

Skilled artisans will appreciate that elements in the figures are illustrated for simplicity and clarity. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

Microphones are provided that allow sound energy to enter through a top opening of a microphone assembly. The sound is routed to a bottom port of the device and enters the device through the bottom port (i.e., a top port opening directly into the interior of the microphone assembly is omitted). In doing so, the signal-to-noise ratio of the device is increased since a larger back volume is utilized (as compared to top port devices).

Dual or multiple MEMS microphone devices are also provided where two or more microphones are disposed in the same assembly. In one particular dual microphone assembly, sound energy for one microphone originates at the top of the assembly and is routed through a channel in the device, across the bottom of the assembly, to the bottom port, and then into the assembly. In the case of the other microphone, sound energy is routed through the substrate and into a bottom port for the second microphone in the assembly.

In the approaches described herein, improved signal-to-noise ratio (SNR) performance is provided because the back volume is much larger compared to a conventional top port MEMS microphone. Routing the sound through a narrow channel adds damping and serves to flatten the resonant peak of the microphone frequency response. The approaches described herein also prevent infiltration of debris from occurring from the exterior of the assembly to the interior of the assembly. In any case, the existence of a difficult path for the debris (down a channel, over a narrow path, and up into the device) is also likely to prevent migration of debris from the outside the microphone to the MEMS backplate/diaphragm.

In many of these embodiments, a microphone assembly comprising includes a base, at least one side wall, and a cover. The at least one side wall is disposed on the base. The cover is coupled to the at least one side wall. The base, the side wall, and the cover form a cavity and the cavity has a MEMS device disposed therein. A top port extends through the cover and a first channel extends through the side wall. The first channel is arranged so as to communicate with the top port. A bottom port extends through the base. The MEMS device is disposed over the bottom port. A second channel is formed and extends along a bottom surface of the base. The second channel extends between and communicates with the first channel and the bottom port. Sound energy received by the top port passes through the first channel, the second channel, and the bottom port and is received at the MEMS device.

In others of these embodiments, a multiple microphone assembly includes a base, at least one side wall, and a cover. The at least one side wall is disposed on the base. The cover is coupled to the at least one side wall. The base, the at least one wall, and the cover form a cavity. The cavity has a first MEMS device and a second MEMS device disposed therein.

A top port extends through the cover. A first channel extends through the at least one side wall and the first channel is arranged so as to communicate with the top port. A first bottom port extends through the base and the first MEMS device is disposed over the first bottom port.

A second channel is formed and extends along a bottom surface of the base. The second channel extends between and communicating with the first channel and the first bottom port. A second bottom port extends through the base and the second MEMS device is disposed over the second bottom port. A third channel is formed and extends along the bottom surface of the base. The third channel extends between and communicates with a fourth channel (that is formed in a substrate) and the second bottom port.

First sound energy is received by the top port passes through the first channel, the second channel, and the bottom port and is received at the first MEMS device. Second sound energy is received from the fourth channel in the substrate and passes through the third channel and the second bottom port to be received at the second MEMS device.

In other aspects, the first MEMS device and the second MEMS device share a single back volume. In other examples, an interior wall partitions the cavity into a first sub-cavity and a second sub-cavity. In some aspects, the first MEMS device is disposed in the first sub-cavity and the second MEMS device is disposed in the second sub-cavity. In still other aspects, the first MEMS device utilizes a first back volume and the second MEMS device utilizes a second back volume. The first back volume is separated from the second back volume by the interior wall.

In some examples, a solder ring is disposed on the bottom surface of the base and the solder ring and the bottom surface of the base form the second channel. In other aspects, the base comprises a printed circuit board. In still other examples, an integrated circuit is disposed in the cavity and is coupled to the first MEMS device or the second MEMS device.

Referring now to FIGS. 1A, 1B, 1C and 1D one example of an acoustic apparatus or assembly 100 (e.g., a microphone) is described. The apparatus or assembly 100 includes a cover 102, side walls 104, a micro-electromechanical system (MEMS) device 106, a diaphragm 108, a MEMS cavity volume 110, a back volume 112, a base printed circuit board 114, an integrated circuit 116, a solder ring 118, and electrical contact pads 120. A bottom port 122 extends through the printed circuit board 114 from a bottom surface 126 of the assembly 100. A vertical channel 124 extends through the assembly 100 from a top surface 128 of the assembly 100 to the bottom surface 126 of the assembly 100.

The cover 102 and side walls 104 are constructed of FR4 material. The body of the micro-electromechanical system (MEMS) device 106 couples sound to the diaphragm 108 of the MEMS device 106. As sound energy enters the device through port 122, the diaphragm moves creating electrical energy that can be processed by the integrated circuit 116. The integrated circuit 116 may be a CMOS integrated circuit that performs amplification to mention one example of a function that the integrated circuit 116 can perform. Other examples of functions can also be provided. The printed circuit board 114 and wire bonds (not shown) provide the electrical interconnections between the integrated circuit 116 and the pads 120. The pads 120 can be connected to external devices in one example.

Figure 1D:
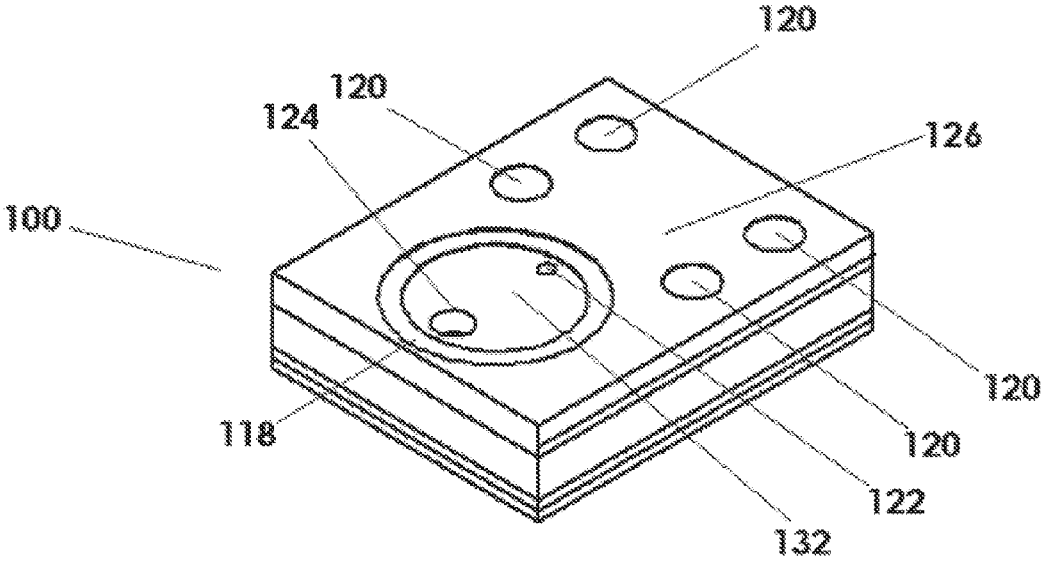
FIG. 1D is a bottom perspective view of the microphone apparatus of FIG. 1A according to various embodiments of the present invention.

The solder ring 118 forms a narrow channel 132 in which sound flows from the vertical channel 124, across the bottom surface 126 of the assembly 100, to the bottom port 122 (and into the assembly 100) in the direction indicated by the arrow labeled 130. The narrow channel 132 is formed with the ring conductor trace and thickness of the applied solder as wall, the apparatus 100 as the top, and the entity on which the apparatus 100 is disposed (e.g., a mounting substrate) being the bottom. In one example, this narrow channel 132 is a sealed space. In other aspects, the narrow channel 132 provides for attenuation of the sound energy that flows through the narrow channel 132. Thus, peak damping of frequency response is provided. The dimensions of the solder ring 118 and the dimensions of the narrow channel 132 (e.g., the distance from the opening of channel 124 and the bottom port 122 and width of the channel) are chosen so as to achieve the amount of damping that is desired. In one example when the solder ring is circular (e.g., see FIG. 1D), the thickness of the conductor ring and solder (i.e., the solder ring) is approximately 100 microns (this thickness of the channel is inclusive of the thickness of conductor ring on the microphone, thickness of the solder between the microphone and substrate, and the thickness of the conductor ring on the substrate), and the length of the narrow channel is approximately 1 mm and the internal diameter of the conductor ring in FIG. 1D is 2.5 mm. This provides damping of approximately 9 dB compared to a top port microphone. The narrow channel also inhibits debris from entering into the apparatus 100 since it is narrow along the path 130.

It will appreciated that sound enters through the top of the apparatus 100, flows through the channel 124, and then flows across the narrow channel 132 and into the device 100 via the bottom port 122. Consequently, the apparatus allows a sound energy to begin traversing its path at the top of the device while still providing the advantages of a bottom port device (e.g., the back volume 112 is relatively large). In other words, the advantages of both a top port device (e.g., the position where the apparatus 100 is disposed requires top port sound entry) and bottom port device (e.g., large back volume) are provided.

It can be seen, for example, that the channel 124 does not flow directly into the interior of the apparatus 100 to interact with the MEMS device 106 as would be the case with prior top port devices. In fact, if a top port were provided into the devices shown here (and the channel 124 omitted), the back volume of the present approaches would become a front volume and the air volume 110 of the present approaches would become a back volume. Hence, the resultant front volume would be much larger than the resultant back volume, when the exact opposite is desired. In contrast, by using the approaches described herein the back volume is significantly larger than the front volume while sound is allowed to begin its journey into the assembly 100 from the top of the assembly 100.

It will be appreciated that the approaches described herein use a vertical channel that passes through the assembly. However, it will be understood that other approaches for moving sound from the top to the bottom (e.g., tubes, pipes, to mention two examples) may also be used.

Figure 2A:
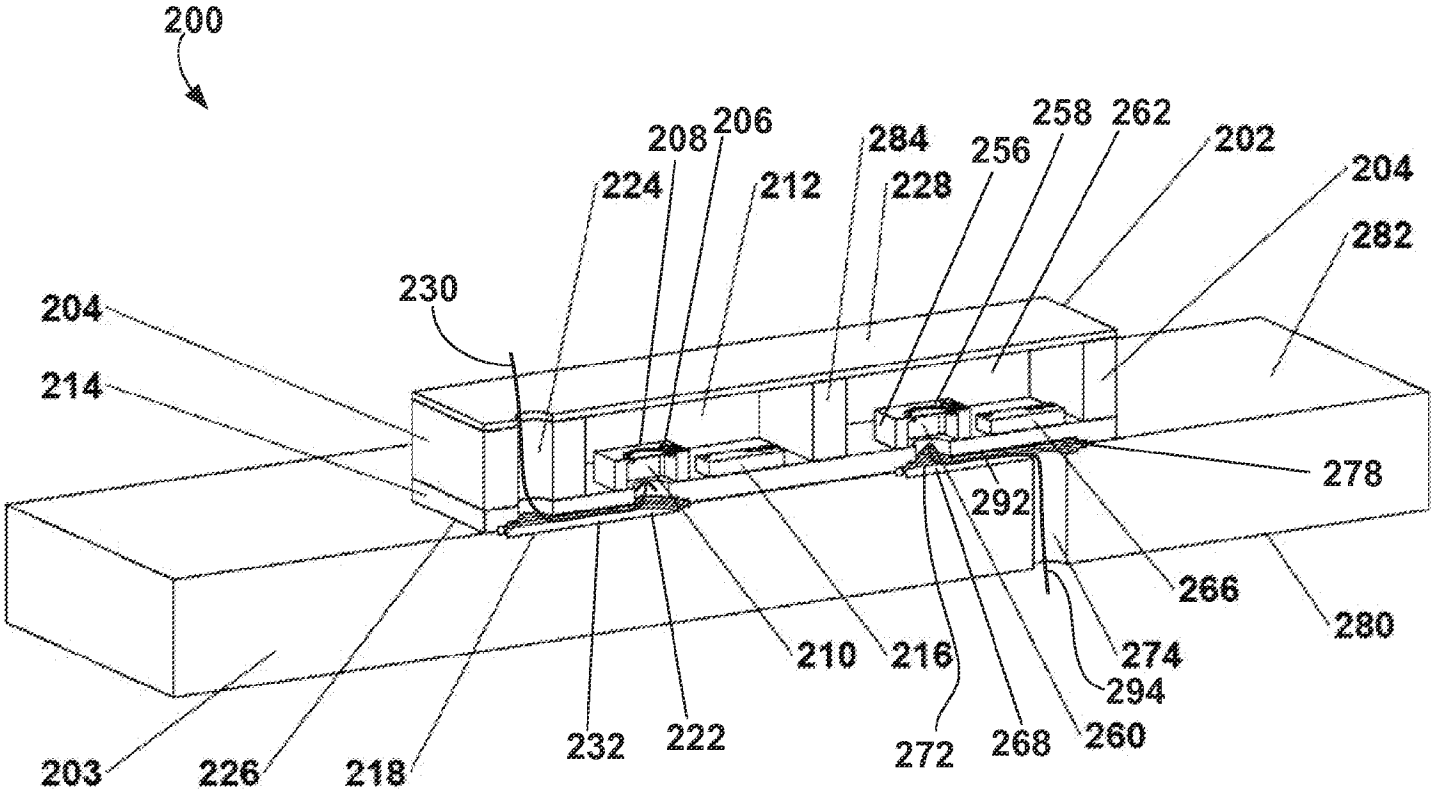
FIG. 2A is a perspective cutaway view of one example of a dual microphone apparatus according to various embodiments of the present invention.
Figure 2B:
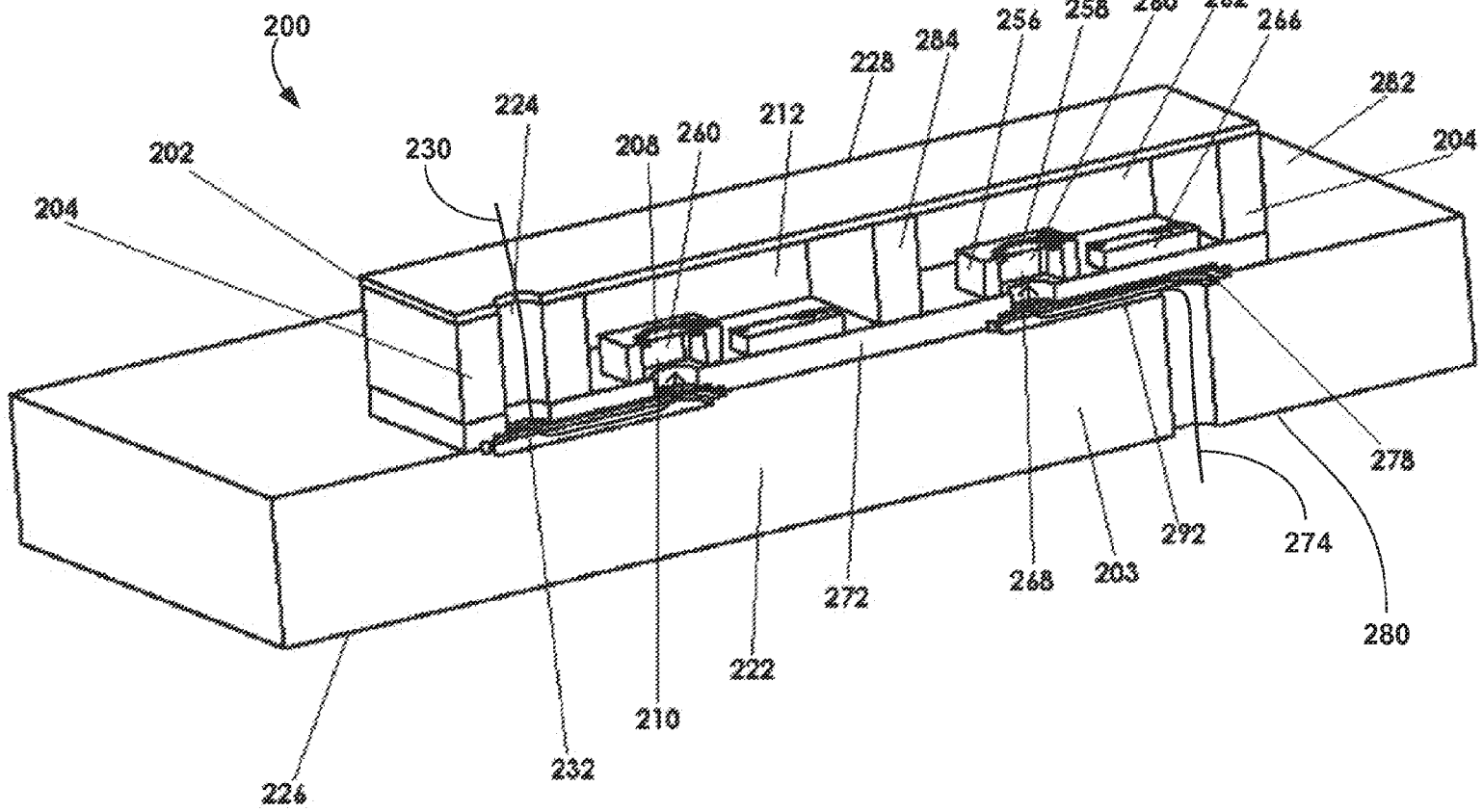
FIG. 2B is a perspective cutaway view of a portion of the dual microphone apparatus of FIG. 2A according to various embodiments of the present invention.

Referring now to FIGS. 2A and 2B, an example of a dual microphone assembly or apparatus 200 is described. Although the assembly of FIGS. 2A and 2B is associated with two microphones, it will be appreciated that these approaches can be applied to devices with any number of microphones. The apparatus 200 includes a cover 202, side walls 204, a first micro-electromechanical system (MEMS) device 206, a first diaphragm 208, a first MEMS cavity volume 210, a first back volume 212, a base printed circuit board 214, a first integrated circuit 216, and a first solder ring 218. A first bottom port 222 extends through the printed circuit board 214 from a bottom surface 226. A first vertical channel 224 extends from a top surface 228 to the bottom surface 226. The first micro-electromechanical system (MEMS) device 206, first diaphragm 208, first MEMS cavity volume 210, first back volume 212, and first integrated circuit 216 form a first microphone of the assembly 200.

The apparatus 200 also includes a second micro-electromechanical system (MEMS) device 256, a second diaphragm 258, a second MEMS cavity volume 260, a second back volume 262, a second integrated circuit 266, and a second solder ring 268. A second bottom port 272 extends through the printed circuit board 214 from a bottom surface 226. A second vertical channel 274 extends from a bottom surface 280 of the mounting substrate 203 to a top surface 282 of the substrate 203. A wall 284 extends between the first microphone and the second microphone. The second micro-electromechanical system (MEMS) device 256, second diaphragm 258, second MEMS cavity volume 260, second back volume 262, and second integrated circuit 266 form a second microphone of the assembly 200.

The various components mentioned above with respect to FIGS. 2A and 2B have similar functions as have been described above with respect to FIGS. 1A-1D and these will not be described or repeated here.

The solder ring 218 forms a narrow channel 232 in which sound energy flows from the vertical channel 224 to the bottom port 222 in the direction indicated by the arrow labeled 230. The narrow channel 232 is formed with the solder rings as a wall, the apparatus 200 as the top surface, and the substrate 203 being the bottom surface of the channel. In one example, this narrow channel 232 is a sealed space. In other aspects, the narrow channel 232 provides for peak damping of the frequency response of the sound energy that flows through the narrow channel 232. The back volume of the microphone is increased relative to a conventional top port MEMS microphone so the SNR of the microphones is improved. The dimensions of the solder ring 218 and the distance of the narrow channel 232 (e.g., the distance from the opening of channel 224 and the bottom port 222, and the width of the channel) are chosen so as to achieve the amount of damping that is desired. In one example when the solder ring is circular, the thickness of the conductor ring and solder (i.e., the solder ring) is approximately 100 microns, the length of the narrow channel is approximately 1 mm and the internal diameter of the conductor ring is 2.5 mm. This provides damping of approximately 9 dB compared to a top port microphone. The narrow channel also inhibits debris from entering into the apparatus 200 since it is narrow along the path 230.

Similarly, the solder ring 268 forms a narrow channel 292 in which sound flows from the vertical channel 274 to the bottom port 272 in the direction indicated by the arrow labeled 294. The narrow channel 292 is formed with the solder rings as walls, the assembly 200 as the top surface, and the substrate 203 as the bottom surface. In one example, this narrow channel 292 is a sealed space. In other aspects, the narrow channel 292 provides for peak damping of the frequency response of the sound energy that flows through the narrow channel 292. The back volume of the microphone is increased relative to a conventional top port MEMS microphone, so the SNR of the microphones is improved. The dimensions of the solder ring 278 and the distance of the narrow channel 292 (e.g., the distance from the opening of channel 274 and the bottom port 272) are chosen so as to achieve the amount of damping that is desired. In one example when the solder ring is circular, the thickness of the conductor ring and solder (i.e., the solder ring) is approximately 100 microns, and the length of the narrow channel is approximately 1 mm and the internal diameter of the conductor ring is 2.5 mm. This provides damping of approximately 9 dB compared to a top port microphone. The narrow channel also inhibits debris from entering into the apparatus 200 since it is narrow along the path 294.

It will appreciated that sound enters through the top of the apparatus 200, flows through the channel 224, then flows across the narrow channel 232 and into the device 200 via the bottom port 222. Consequently, the apparatus allows a sound energy to begin traversing its path at the top of the device while still providing the advantages of a bottom port device (e.g., the back volume 212 is relatively large). In other words, the advantages of both a top port device (e.g., the position where the apparatus 200 is disposed requires top port sound entry) and bottom port device (e.g., large back volume) are provided. Sound energy can also flow into the other microphone via the vertical channel 274, narrow channel 292 and bottom port 272.

It can be further seen, for example, that the channel 224 does not flow into the interior of the apparatus 200 to interact with the MEMS device 206 as would be the case with top port devices. In fact, if a top port were provided in the present approaches, the back volume of the present approaches would become a front volume and the MEMS cavity volume of the present approaches would become a back volume. Hence, the resultant front volume would be much larger than the resultant back volume, when the exact opposite is desired. In contrast, by using the approaches described herein the back volume is significantly larger than the front volume while still allowing sound to begin its path into the assembly 200 at the top of the assembly 200.

Figure 3A:
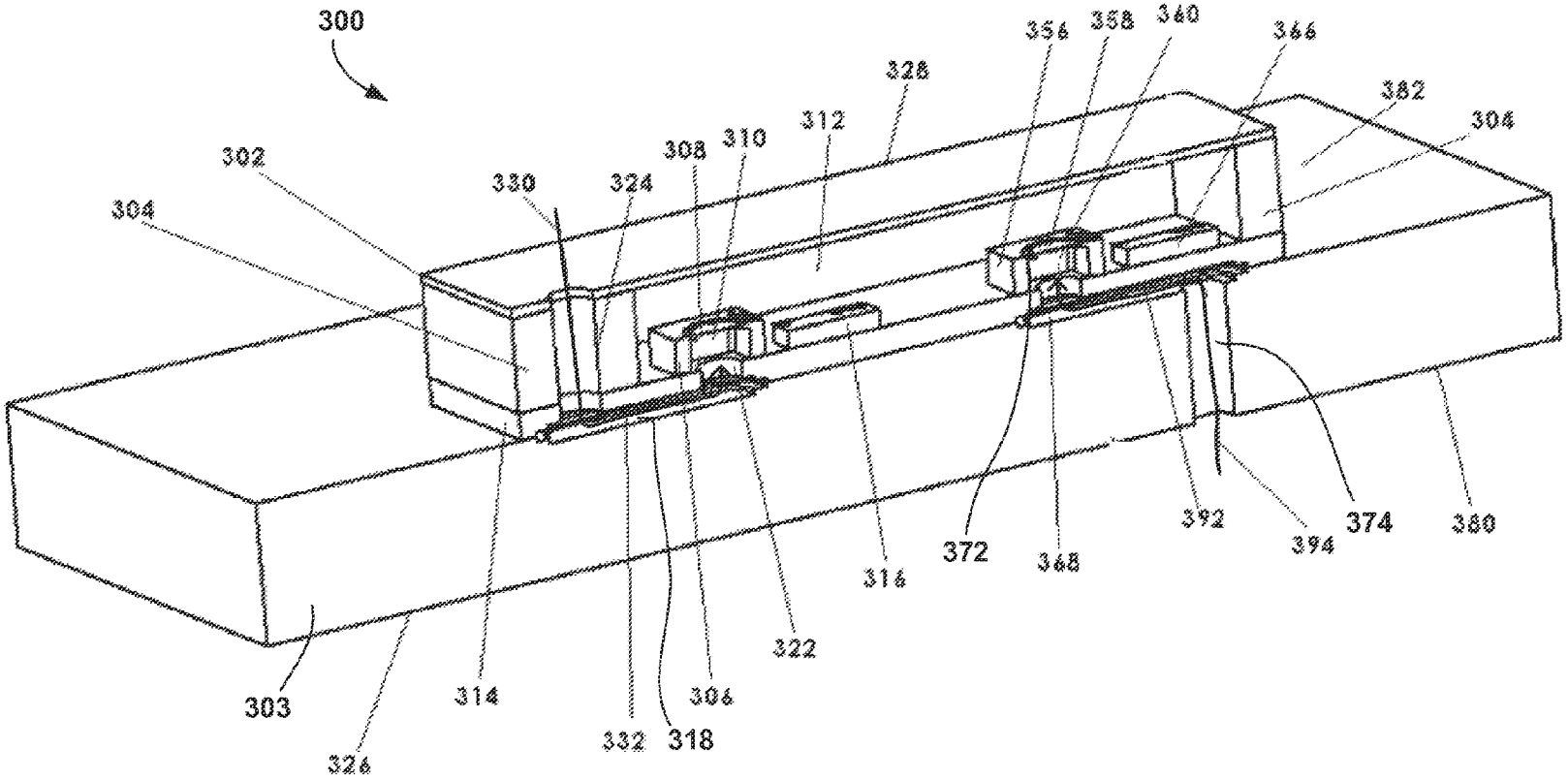
FIG. 3A is a perspective cutaway view of one example of a dual microphone apparatus according to various embodiments of the present invention.
Figure 3B:
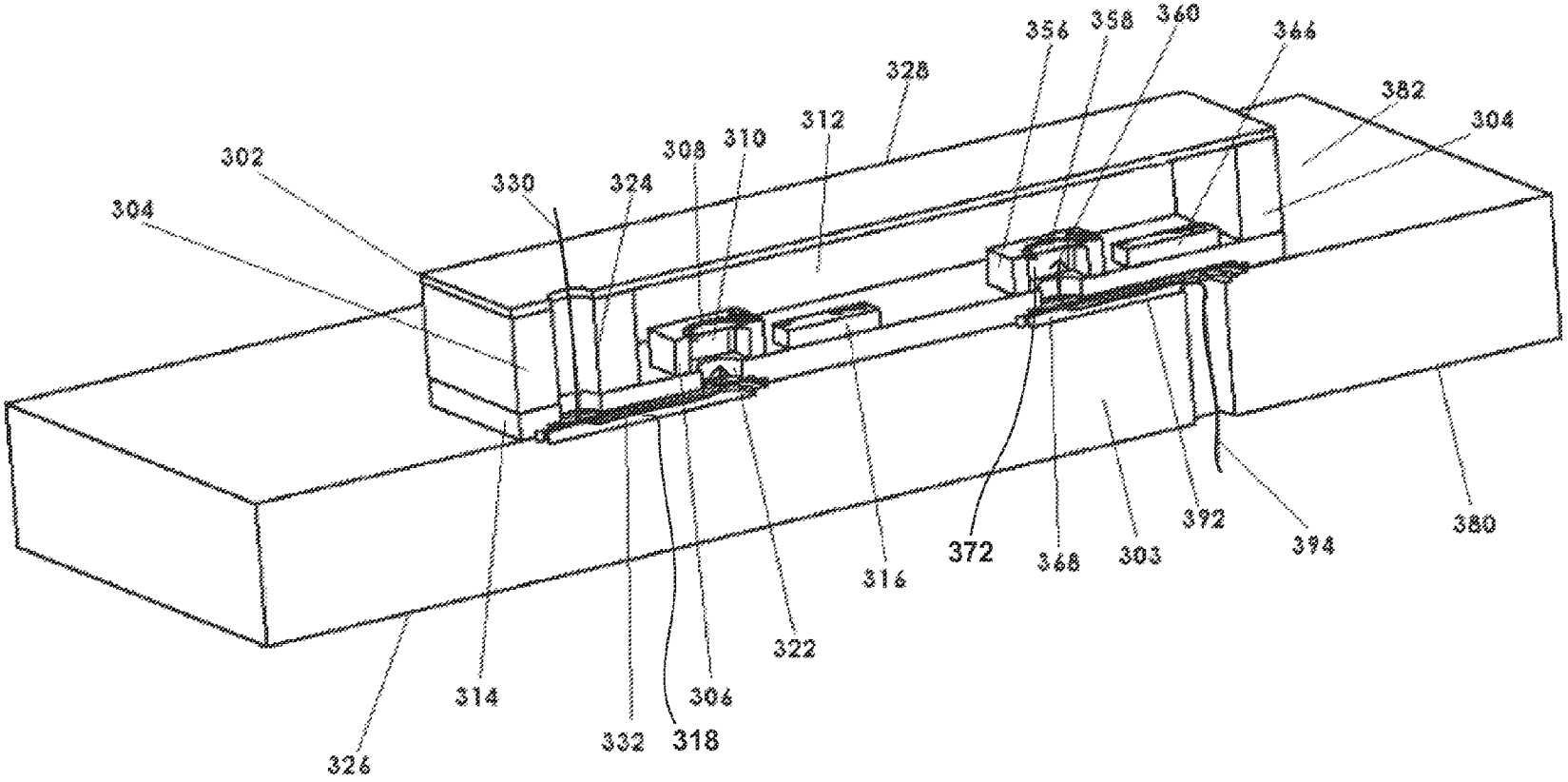
FIG. 3B is a perspective cutaway view of a portion of the dual microphone apparatus of FIG. 3A according to various embodiments of the present invention.

Referring now to FIGS. 3A and 3B, another example of a dual microphone apparatus 300 is described. Although the devices of FIGS. 3A and 3B can be applied to an apparatus with two microphones, it will be appreciated that these approaches can be applied to devices with any number of microphones. The apparatus 300 includes a cover 302, side walls 304, a first micro-electromechanical system (MEMS) device 306, a first diaphragm 308, a first MEMS cavity volume 310, a common back volume 312, a base printed circuit board 314, a first integrated circuit 316, and a first solder ring 318. A first bottom port 322 extends through the printed circuit board 314 from a bottom surface 326 of the assembly 300. A first vertical channel 324 extends from a top surface 328 of the assembly 300 to the bottom surface 326 of the assembly 300.

The apparatus 300 also includes a second micro-electromechanical system (MEMS) device 356, a second diaphragm 358, a second MEMS cavity volume 360, a second integrated circuit 366, and a second solder ring 368. A second bottom port 372 extends through the printed circuit board 314 from a bottom surface 326 of the assembly 300. A second vertical channel 374 extends from a bottom surface 380 of the substrate 303 to a top surface 382 of the substrate 303.

In contrast to the system of FIG. 2A and FIG. 2B, a wall 284 is not disposed between the first microphone and the second microphone and the two microphones share the common back volume 312. The various components have similar functions as have been described above and these will not be described or repeated here. The use of a common back volume 312 simplifies the design and manufacturing of the apparatus 300 and allows a larger back volume 312 to be used than if a barrier wall is inserted between the two microphones.

The use of dual microphones allows matching of sensitivities to occur. More specifically, when constructing the dual microphones both microphones would be constructed from the same batch of material and as a result it would be likely the two microphones would have matched or substantially matched sensitivities. In another advantage of the dual microphone examples, if the vertical and narrow channels of each microphone are of the same or substantially the same dimensions, then the frequency response curve for each microphone will be equal or substantially equal.

The approaches described herein can also include manufacturing any of the devices described herein. For example, the components may be assembled and a boring device used to drill the vertical channels through the assemblies. A solder ring can be later applied and then the device can be mounted to a PCB substrate. The hole through the microphone element may be drilled after the rest of the assembly is assembled, or it may be drilled in the cover, wall, and base prior to lamination of the layers.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A microphone assembly comprising:

a base, the base having a bottom surface, the bottom surface being a single plane;

at least one side wall disposed on the base;

a cover coupled to the at least one side wall, wherein the base, the at least one side wall, and the cover form a cavity, the cavity having a MEMS device disposed therein;

a top port extending through the cover;

a first channel extending through the at least one side wall, the first channel arranged so as to communicate with the top port;

a bottom port extending through the base, wherein the MEMS device is disposed over the bottom port;

a second channel formed and extending along a bottom surface of the base, portions of the bottom surface of the base being exposed to the exterior of the assembly and not being in direct contact with the MEMS device, the second channel extending between and communicating with the first channel and the bottom port wherein the second channel is formed by a raised solder ring, the bottom surface of the base, and a mounting substrate, wherein the solder ring is disposed on the bottom surface, and wherein one side of the second channel is coextensive with the plane of the base and does not extend into the base;

such that sound energy received by the top port passes through the first channel, the second channel, and the bottom port and is received at the MEMS device.

2. The microphone assembly of claim 1 wherein the base comprises a printed circuit board.

3. The microphone assembly of claim 1 further comprising an integrated circuit disposed in the cavity and coupled to the MEMS device.

4. The microphone assembly of claim 1 wherein the MEMS device defines a front volume and a back volume and the back volume is significantly larger than the front volume.

5. A multiple microphone assembly comprising:

a base, the base having a bottom surface, the bottom surface being a single plane;

at least one side wall disposed on the base;

a cover coupled to the at least one side wall, wherein the base, the at least one wall, and the cover form a cavity, the cavity having a first MEMS device and a second MEMS device disposed therein;

a top port extending through the cover;

a first channel extending through the at least one side wall, the first channel arranged so as to communicate with the top port;

a first bottom port extending through the base, wherein the first MEMS device is disposed over the first bottom port;

a second channel formed and extending along a bottom surface of the base, portions of the bottom surface of the base being exposed to the exterior of the assembly and not being in direct contact with the MEMS device, the second channel extending between and communicating with the first channel and the first bottom port wherein the second channel is formed by a first raised solder ring, the bottom surface of the base, and a mounting substrate, wherein the first solder ring is disposed on the bottom surface, and wherein one side of the second channel is coextensive with the plane of the base and does not extend into the base;

a second bottom port extending through the base, wherein the second MEMS device is disposed over the second bottom port;

a third channel formed and extending along the bottom surface of the base, the third channel extending between and communicating with a fourth channel in a substrate and the second bottom port wherein the third channel is formed by a second raised solder ring, the bottom surface of the base, and a mounting substrate, wherein the second solder ring is disposed on the bottom surface, and wherein one side of the third channel is coextensive with the plane of the base and does not extend into the base;

such that first sound energy received by the top port passes through the first channel, the second channel, and the bottom port and is received at the first MEMS device; and such that second sound energy received from the fourth channel in the substrate passes through the third channel and the second bottom port and is received at the second MEMS device.

6. The multiple microphone assembly of claim 5 wherein the first MEMS device and the second MEMS device share a single back volume.

7. The multiple microphone assembly of claim 5 further comprising an interior wall, the interior wall partitioning the cavity into a first sub-cavity and a second sub-cavity.

8. The multiple microphone assembly of claim 7 wherein the first MEMS device is disposed in the first sub-cavity and the second MEMS device is disposed in the second sub-cavity.

9. The multiple microphone assembly of claim 8 wherein the first MEMS device utilizes a first back volume and the second MEMS device utilizes a second back volume, and the first back volume is separated from the second back volume by the interior wall.

10. The multiple microphone assembly of claim 5 wherein the base comprises a printed circuit board.

11. The multiple microphone assembly of claim 5 further comprising an integrated circuit disposed in the cavity and coupled to the first MEMS device or the second MEMS device.

12. The multiple microphone assembly of claim 5:

wherein the first MEMS device and the second MEMS device form at least one front volume;

wherein the first MEMS device and the base form a first front volume;

wherein the second MEMS device and the base foam a second front volume; and wherein the at least one back volume is significantly larger than the first front volume or the second front volume.

* * * * *